US007370954B2

(12) United States Patent
Fujikura

(10) Patent No.: US 7,370,954 B2
(45) Date of Patent: May 13, 2008

(54) IMAGE FORMING APPARATUS

(75) Inventor: Shuichi Fujikura, Tokyo (JP)

(73) Assignee: Oki Data Corporation, Tokyo (JP)

( * ) Notice: Subject to any disclaimer, the term of this patent is extended or adjusted under 35 U.S.C. 154(b) by 292 days.

(21) Appl. No.: 11/029,645

(22) Filed: Jan. 6, 2005

(65) Prior Publication Data

US 2005/0174377 A1 Aug. 11, 2005

(30) Foreign Application Priority Data

Jan. 9, 2004 (JP) ..... 2004-004566

(51) Int. Cl.
*B41J 2/01* (2006.01)

(52) U.S. Cl. ..... 347/101; 347/102; 347/16; 347/19

(58) Field of Classification Search ..... 347/102, 347/16, 101, 5, 14, 19, 9, 12
See application file for complete search history.

(56) References Cited

U.S. PATENT DOCUMENTS

| | | | | |
|---|---|---|---|---|
| 5,500,667 A * | 3/1996 | Schwiebert et al. | ..... | 347/102 |
| 6,428,161 B1 * | 8/2002 | Wotton et al. | ..... | 347/102 |
| 6,582,072 B1 * | 6/2003 | Wotton et al. | ..... | 347/104 |
| 6,640,716 B1 * | 11/2003 | Alonso et al. | ..... | 101/484 |

FOREIGN PATENT DOCUMENTS

| | | | |
|---|---|---|---|
| JP | 2001282042 A | * | 10/2001 |
| JP | 2002314800 A | * | 10/2002 |
| JP | 2002-333744 | | 11/2002 |
| JP | 2003039550 A | * | 2/2003 |

OTHER PUBLICATIONS

Machine Traslation for IDS document JP 2002-333744.*

* cited by examiner

*Primary Examiner*—Stephen Meier
*Assistant Examiner*—Ly T. Tran
(74) *Attorney, Agent, or Firm*—Rabin & Berdo, P.C.

(57) ABSTRACT

A medium contraction amount calculating unit calculates a medium length contraction amount in a fixing process of a recording medium in first printing from a medium length before the fixing process and a medium length after the fixing process. A write timing setting unit has medium contraction amount distributing means which center-distributes time corresponding to the medium length contraction amount to print start timing and print end timing in the next and subsequent printing and sets image write timing in the next and subsequent printing of the recording medium on the basis of the distribution by the medium contraction amount distributing means. When the same image is printed onto both surfaces or onto the same surface, the positional change of the same image can be made inconspicuous.

18 Claims, 5 Drawing Sheets

IMAGE FORMING APPARATUS

BACKGROUND OF THE INVENTION

1. Field of the Invention

The invention relates to an image forming apparatus such as a printer or the like having a function for printing images onto both surfaces of a recording medium or a function for printing an image onto the same surface a plurality of number of times.

2. Related Background Art

In a conventional image forming apparatus using a heat fixing system, such a phenomenon that the moisture contained in a recording medium is evaporated by the heat of the thermal fixing and the recording medium is contracted after the fixing occurs. Therefore, in the case of printing images onto both surfaces of the recording medium or in the case of printing an image onto the same surface a plurality of number of times, after the image printed first was fixed, the image of the second time is transferred, so that a size of image printed first and a size of image printed at the second time differ. Therefore, particularly, in the case where the same image is printed onto both surfaces or onto the same surface, or the like, an inconvenience that a positional change of the same image is apt to be conspicuous occurs.

To solve such a problem, a technique in which against contraction of the recording medium that is caused by an influence of heat fixing, a correction value of print contents corresponding to such contraction is preset and the influence of the contraction is eliminated by the correction value, or the like has been opened (for example, refer to JP-A-2002-333744).

However, according to such a technique, since it is necessary to previously preset correction values with respect to all kinds of recording media capable of being used in the image forming apparatus, the operation is troublesome. A problem to be solved that since it is necessary to add a storing apparatus or the like, the apparatus becomes complicated and it results in an increase in costs still remains.

It is a problem to be solved that, particularly, in the case where the same image is printed onto both surfaces or onto the same surface, the positional change of the same image is likely to be conspicuous.

SUMMARY OF THE INVENTION

It is an object of the invention to provide an image forming apparatus such as a printer or the like having a function for printing images onto both surfaces of a recording medium or a function for printing an image onto the same surface a plurality of number of times.

According to the present invention, there is provided an image forming apparatus comprising:

a medium contraction amount calculating unit which calculates a medium length contraction amount on the basis of a medium length of a recording medium before a fixing process for fixing an image formed in the recording medium, and on the basis of a medium length of the recording medium after the fixing process; and an image formation timing setting unit for setting the timing to form an image in subsequent recording medium which will be subsequently printed, on the basis of the medium length contraction amount calculated by the medium contraction amount calculating unit.

The image forming apparatus may further comprise a medium conveyance amount calculating unit which calculates a medium conveyance amount which corresponds to the medium length contraction amount calculated by the medium contraction amount calculating unit, wherein the image formation timing setting unit in order to set the timing to form an image in subsequent recording medium which will be subsequently printed, uses the medium conveyance amount corresponding to the medium length contraction amount.

The image forming apparatus may further comprise a conveyance amount dividing unit for apportioning the medium conveyance amount calculated by the medium conveyance amount calculating unit to the subsequent recording medium which will be subsequently printed, between printing start and printing end.

The image forming apparatus may further comprise a medium conveyance time calculating unit which calculates a medium conveyance time which corresponds to the medium length contraction amount calculated by the medium contraction amount calculating unit, wherein the image formation timing setting unit in order to set the timing to form an image in subsequent recording medium which will be subsequently printed, uses the medium conveyance time corresponding to the medium length contraction amount.

Moreover, in the image forming apparatus, the image formation timing setting unit has a timing adding/subtracting portion to adds/subtracts the medium conveyance amount to/from the printing start time.

Moreover, in the image forming apparatus, the image formation timing setting unit has a timing adding/subtracting portion to adds/subtracts the medium conveyance time to/from the printing start time.

Moreover, in the image forming apparatus, the timing adding/subtracting portion detects an error amount between the medium length before the fixing process and a length that is stored in correspondence to the recording medium, and adds/subtracts medium conveying amount corresponding to the error amount to/from printing start timing of the subsequent recording medium.

Moreover, in the image forming apparatus, the timing adding/subtracting portion detects an error amount between the medium length before the fixing process and a length that is stored in correspondence to the recording medium, and adds/subtracts medium conveying time corresponding to the error amount to/from printing start timing of the subsequent recording medium.

Moreover, The image forming apparatus may further comprise a main scan writing position changing unit which converts the medium length contraction amount into a medium width contraction amount in a main scanning direction, and on the basis of the medium width contraction amount, changes a main scan writing position in the next and subsequent printing.

Moreover, the image forming apparatus may further comprise a main scan enlarging/reducing unit which enlarges or reduces an image in the next and subsequent printing in a main scanning direction on the basis of the medium length contraction amount.

According to the present invention, there is also provided an image forming apparatus comprising:

a medium contraction amount calculating unit which calculates a medium length contraction amount on the basis of a medium length of a recording medium before a fixing process for fixing an image formed in the recording medium, and on the basis of a medium length of the recording medium after the fixing process; and an exposing device period setting unit which sets an operating period of an exposing device in the next and subsequent printing on the basis of the medium length contraction amount.

The image forming apparatus may further comprise a medium conveyance time calculating unit which calculates a medium conveyance time which corresponds to the medium length contraction amount calculated by the medium contraction amount calculating unit, and wherein the exposing device period setting unit, in order to set the operating period of an exposing device in the next and subsequent printing, uses the uses the medium conveyance time corresponding to the medium length contraction amount.

Moreover, in the image forming apparatus, the exposing device period setting unit has a timing adding/subtracting portion to adds/subtracts the medium conveyance time to/from a exposing start time in the next and subsequent printing.

Moreover, in the image forming apparatus, the timing adding/subtracting portion detects an error amount between the medium length before the fixing process and a length that is stored in correspondence to the recording medium, and adds/subtracts the medium conveying time corresponding to the error amount to/from the exposing start timing in the next and subsequent printing.

Moreover, the image forming apparatus may further comprise a main scan writing position changing unit which converts the medium length contraction amount into a medium width contraction amount in a main scanning direction, and on the basis of the medium width contraction amount, changes a main scan writing position in the next and subsequent printing.

Moreover, the image forming apparatus may further comprise a main scan enlarging/reducing unit which enlarges or reduces an image in the next and subsequent printing in a main scanning direction on the basis of the medium length contraction amount.

According to the invention, the image forming apparatus has a medium contraction amount calculating unit and a write timing setting unit and the contraction amount due to the first printing is distributed onto the images of the second and subsequent printings. Thus, an effect that, particularly, in the case where the same image is printed onto both surfaces or onto the same surface, the positional change of the same image can be made inconspicuous is obtained.

The above and other objects and features of the present invention will become apparent from the following detailed description and the appended claims with reference to the accompanying drawings.

DETAILED DESCRIPTION OF THE PREFERRED EMBODIMENTS

A medium contraction amount calculating unit and a write timing setting unit are constructed by control means of a CPU (central processing unit) which controls a whole image forming apparatus. A medium length before a fixing process is detected by an existing writing sensor and a medium length after the fixing process is detected by an existing ejecting sensor, respectively, so that the invention can be realized without causing an increase in number of parts.

Embodiment 1

Figure 1:
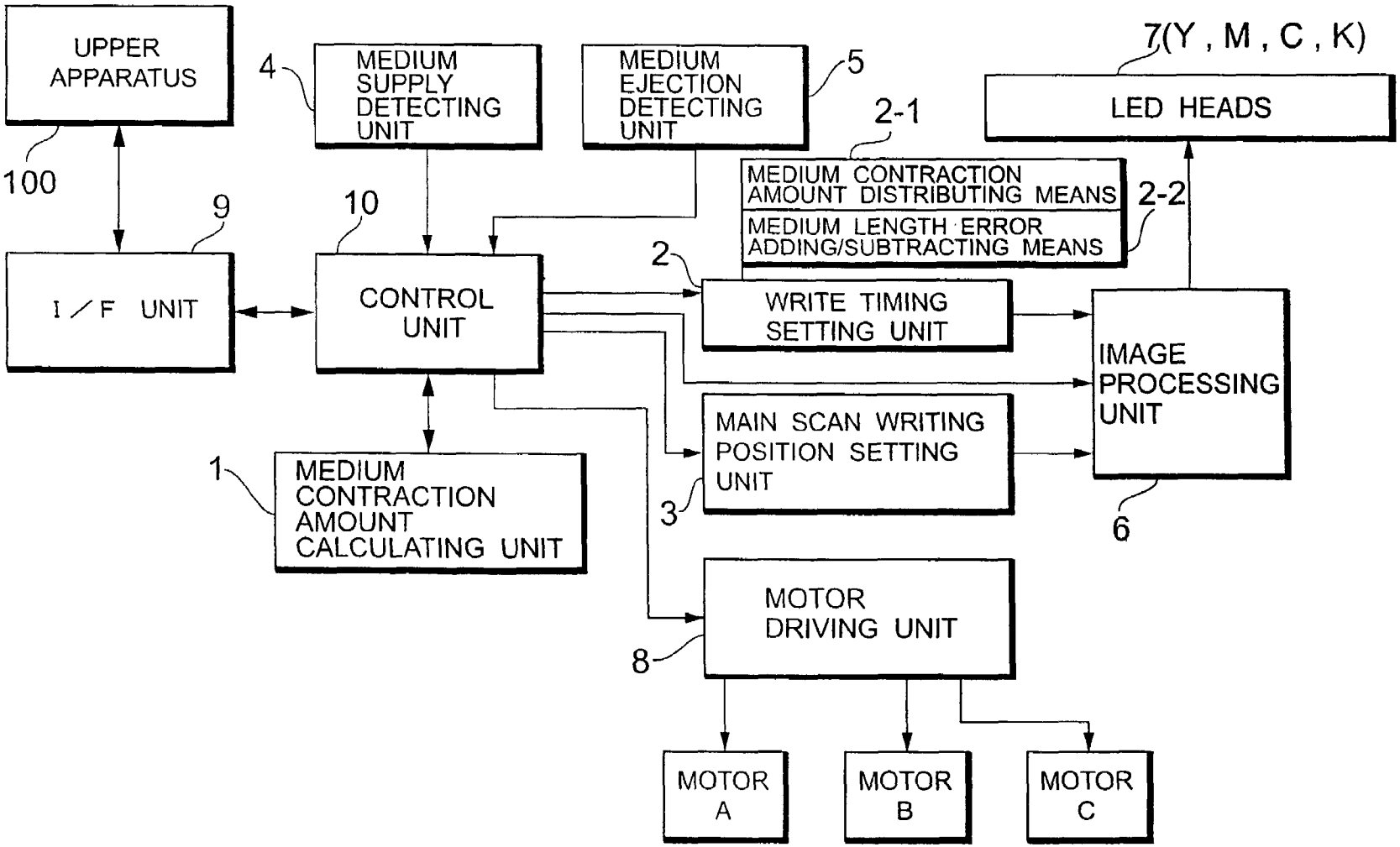
FIG. 1 is a block diagram of a construction of the embodiment 1.

FIG. 1 is a block diagram of a construction of the embodiment 1.

As shown in the diagram, an image forming apparatus of the embodiment 1 comprises: a medium contraction amount calculating unit 1; a write timing setting unit 2; a main scan writing position setting unit 3; a medium supply detecting unit 4; a medium ejection detecting unit 5; an image processing unit 6; LED heads 7; a motor driving unit 8; an I/F (interface) unit 9; and a control unit 10.

Prior to explaining details of each of the above composing portions, an outline of a mechanism portion of the image forming apparatus to which the embodiment is applied and its operation will be described.

Figure 2:
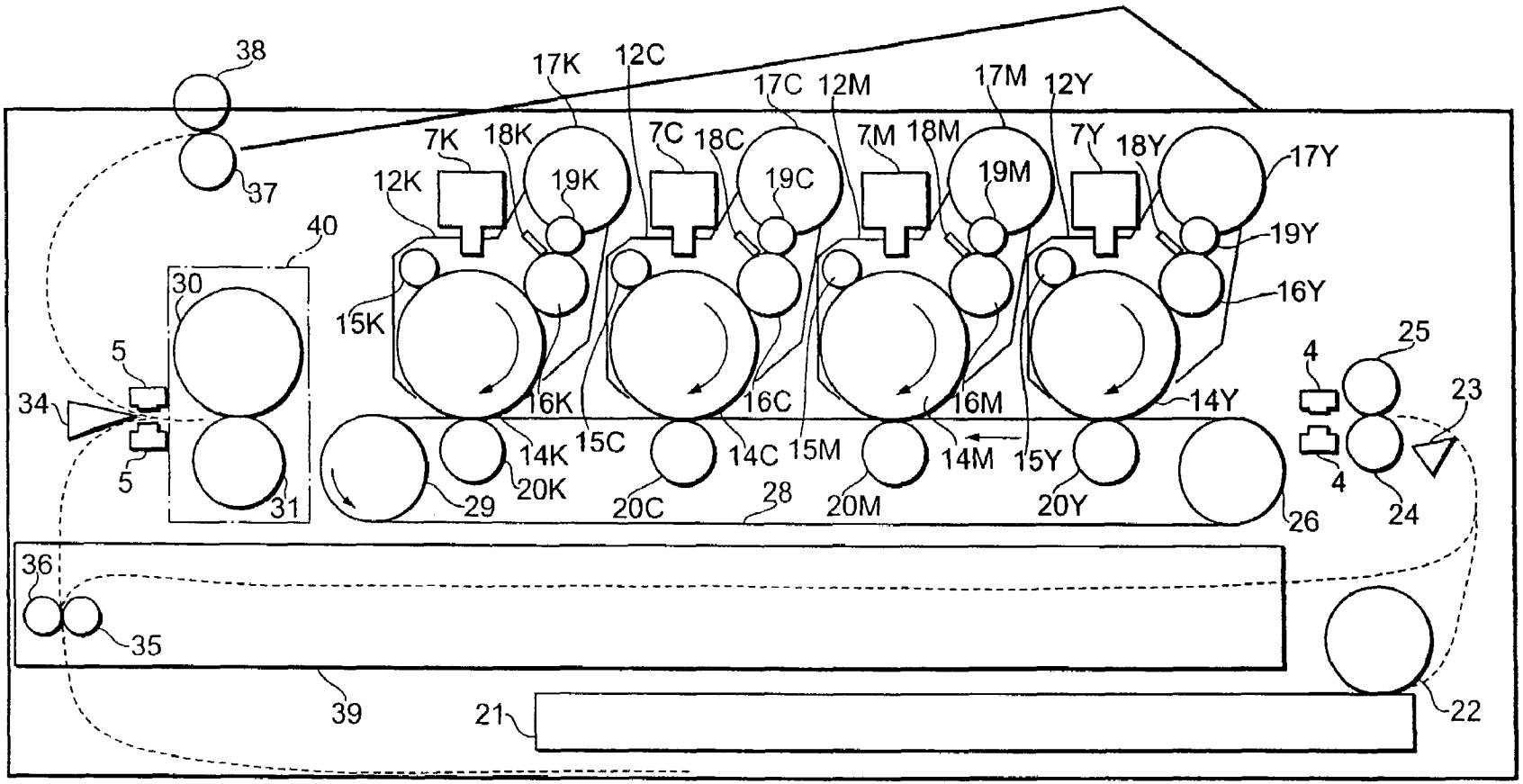
FIG. 2 is an explanatory diagram of a mechanism of a printer to which the invention is applied.

FIG. 2 is an explanatory diagram of a mechanism of a printer to which the invention is applied.

In the following description, a component for yellow is abbreviated to Y, magenta to M, cyan to C, and black to K (Y, M, C, K), respectively.

As shown in the diagram, the mechanism portion of the image forming apparatus to which the invention is applied comprises: image forming units 12 (Y, M, C, K) each for forming a toner image on the basis of image data which is transmitted from the image processing unit 6 (FIG. 1); and transfer rollers 20 (Y, M, C, K) each for transferring the formed toner image onto a recording medium. A plurality of recording media (recording paper) are enclosed on a sheet cassette 21 and sequentially picked up from the sheet cassette 21 by a paper feed roller 22.

The recording media which were sequentially picked up are detected by an entrance sensor 23. Further, a front edge portion and a medium length of each recording medium are detected by the medium supply detecting unit 4. The recording medium is supplied by conveying rollers 24 and 25 onto a conveying belt 28 which is circulating at a predetermined speed. The conveying belt 28 is driven by a belt driving roller 29 and tension of the belt is held constant by a belt driven roller 26.

The recording medium which was conveyed on the conveying belt 28 and on which the toner image has been transferred by the image forming units 12 (Y, M, C, K) and the transfer rollers 20 (Y, M, C, K) is fed to a fixing device 40 comprising a fixing roller 30 and a fixing backup roller 31. The recording medium on which the toner image has been transferred is heated at a high pressure in the fixing device 40, so that the toner is fixed onto the recording medium.

At this time, the moisture and the like in the medium are released by the high-pressure heating, so that the recording medium contracts. It should be noted that most of the moisture and the like are released by printing the recording medium first and fixing it, so that the contraction of the recording medium in the printing subsequent to the first-time printing (for example, upon duplex printing) lies within a range where it can be ignored (Note 1).

After the front edge portion and the medium length of the recording medium obtained after completion of the fixing process are detected by the medium ejection detecting unit 5, the fixed recording medium is conveyed to a separator 34. The paper feeding mode of the recording medium is switched to either "paper re-feed" or "ejection" by the separator 34. If it is switched to the ejection, the fixed recording medium is ejected by ejecting rollers 37 and 38. If it is switched to the paper re-feed, the fixed recording medium is temporarily taken out of the fixing device 40 by reversing rollers 35 and 36 and fed to the lower side of the sheet cassette 21 in the diagram. After that, the reversing rollers 35 and 36 are reversely rotated, so that the recording medium is fed to the conveying rollers 24 and 25 and moved again along the same route as that mentioned above.

It should be noted to the following point here (Note 2). That is, when the paper feeding mode is switched to the paper re-feed, first, a front edge portion of the recording medium is fed to the lower side of the sheet cassette 21, thereafter, the reversing rollers 35 and 36 are reversely rotated, and the medium is fed to the conveying rollers 24 and 25. Therefore, the recording medium is turned over (face-down) and, further, the rear edge portion of the recording medium is fed to the conveying rollers 24 and 25 first. In other words, in the duplex printing mode, the front edge portion and the rear edge portion of the recording medium in the first printing and those in the next printing are in a reversal relation.

A schematic construction and the operation of the image forming unit 12 will now be described. As shown in the diagram, the image forming apparatus has the four image forming units 12 (Y, M, C, K) for forming the toner images of four colors of yellow (Y), magenta (M), cyan (C), and black (K). Photosensitive drums 14 (Y, M, C, K) which are rotated clockwise are arranged in the image forming units 12 (Y, M, C, K). The surfaces of the photosensitive drums 14 (Y, M, C, K) are charged to the negative polarity by charging rollers 15 (Y, M, C, K), respectively.

When the portions charged to the negative polarity by rotating the photosensitive drums 14 (Y, M, C, K) reach just under the LED heads 7 (Y, M, C, K), the LED heads 7 (Y, M, C, K) expose them on the basis of the image data sent from the image processing unit 6 (FIG. 1). Electrostatic latent images corresponding to the image data are formed on the surfaces of the photosensitive drums 14 (Y, M, C, K) by the exposure.

When the photosensitive drums 14 (Y, M, C, K) are rotated and the electrostatic latent images reach the positions of developing rollers 16 (Y, M, C, K), the electrostatic latent images are developed by the developing rollers 16 (Y, M, C, K), so that the toner images are formed on the surfaces of the photosensitive drums 14 (Y, M, C, K). The toner of the respective colors is supplied to the developing rollers 16 (Y, M, C, K) from toner tanks 17 (Y, M, C, K) through sponge rollers 19 (Y, M, C, K) for supplying the toner and developing blades 18 (Y, M, C, K), respectively.

When the photosensitive drums 14 (Y, M, C, K) are rotated and the toner images reach the positions of the transfer rollers 20 (Y, M, C, K), the toner images are transferred onto the recording medium by high electric fields of the positive polarity which are applied to the transfer rollers 20 (Y, M, C, K). After that, the recording medium is ejected or fed again along the foregoing route.

It should be noted to the following point here (Note 3). That is, the time when a predetermined position of the recording medium to be printed excluding a blank of the front edge portion of the medium reaches the positions of the transfer rollers 20 (Y, M, C, K) is predicted from the time when the front edge portion of the recording medium is detected by the medium supply detecting unit 4. The LED heads 7 (Y, M, C, K) have to expose the images corresponding to the image data onto the photosensitive drums 14 (Y, M, C, K) so that the toner images on the surfaces of the photosensitive drums 14 (Y, M, C, K) reach the positions of the transfer rollers 20 (Y, M, C, K) at the predicted time.

Since the outline and the operation of the mechanism portion of the image forming apparatus to which the invention is applied have been described above, details of the construction of the embodiment 1 will now be described with reference to FIG. 1 again.

The medium contraction amount calculating unit 1 is a portion for calculating a medium length contraction amount in the fixing process of the recording medium in the first printing from the medium length before the fixing process and the medium length after the fixing process.

The write timing setting unit 2 is a portion for setting the timing when the LED heads 7 (Y, M, C, K) expose the images corresponding to the image data onto the photosensitive drums 14 (Y, M, C, K) on the basis of the time when the front edge portion of the recording medium is detected by the medium supply detecting unit 4. Further, the write timing setting unit 2 has medium contraction amount distributing means 2-1 and medium length error adding/subtracting means 2-2 and is also a portion for setting the image write timing in the next and subsequent printing operations of the recording medium.

The medium contraction amount distributing means 2-1 is means for center-distributing the medium conveying time corresponding to the medium length contraction amount in the fixing process of the recording medium in the first printing to the writing start timing and the write end timing in the next and subsequent printing operations and setting the write timing for the next and subsequent printing operations.

The medium length error adding/subtracting means 2-2 is means for detecting an error amount from a predetermined rated length of the recording medium, adding or subtracting the medium conveying time corresponding to the detected error amount to/from the write timing for printing onto the opposite surface of the recording medium, and setting the image write timing. Moreover, regarding the predetermined rated length, for example, the data such as A4=210 mm×297 mm, Letter=215.9 mm×279.4 mm, or the like is previously stored in memory.

The main scan writing position setting unit 3 is a portion for converting the medium length contraction amount into a medium width contraction amount in the main scanning direction and center-distributing the medium width contraction amount to the main scan writing position in the next and subsequent printing operations.

The medium supply detecting unit 4 is a portion for detecting the passage of the front edge portion and the rear edge portion of the recording medium, thereby detecting the medium length of the recording medium before the fixing process. The conventional writing sensor arranged in the image forming apparatus takes partial charge of such a role.

The medium ejection detecting unit 5 is a portion for detecting the passage of the front edge portion and the rear edge portion of the recording medium, thereby detecting the medium length of the recording medium after the fixing process. The conventional ejection sensor arranged in the image forming apparatus takes partial charge of such a role.

The image processing unit 6 is a portion for forming image data on the basis of image information received from an upper apparatus 100 and sending it to the LED heads 7 (Y, M, C, K).

The LED heads 7 (Y, M, C, K) are exposing devices for receiving the image data from the image processing unit 6 and exposing the images corresponding to the image data onto the photosensitive drums 14 (Y, M, C, K), thereby forming electrostatic latent images onto the surfaces of the photosensitive drums 14 (Y, M, C, K), respectively. Although the LED heads are used in the embodiment, a laser exposing unit constructed by a small laser and a polygon mirror can be also used.

The motor driving unit 8 is a portion for driving various motors A, B, and C arranged in the apparatus on the basis of control of the control unit 10.

The I/F unit 9 is an interface portion between the upper apparatus 100 and the image forming apparatus.

The control unit 10 is a CPU (central processing unit) which controls the whole image forming apparatus.

A fundamental principle of the embodiment will now be described.

Figure 3:
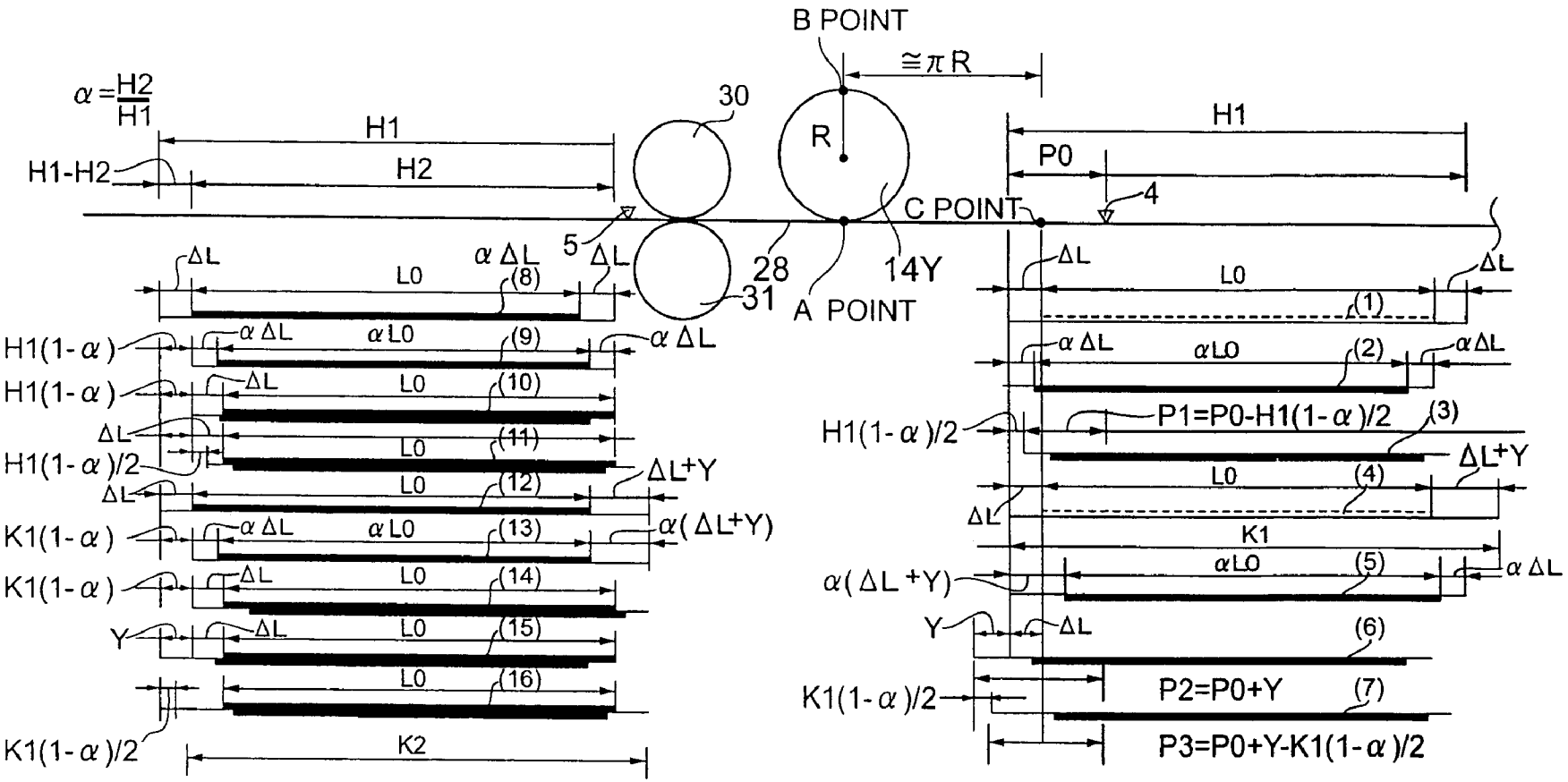
FIG. 3 is an explanatory diagram of a fundamental principle of the embodiment 1.

FIG. 3 is an explanatory diagram of the fundamental principle of the embodiment 1.

An image of a conveying path of the image forming apparatus according to the invention is illustrated at the top stage of the diagram. A black line drawn from the right end to the left end in the diagram is an image of the conveying belt 28 (FIG. 2) and it is assumed that the medium supply detecting unit 4 (FIG. 2), the photosensitive drum 14Y (FIG. 2), the fixing roller 30 (FIG. 2), the fixing backup roller 31 (FIG. 2), and the medium ejection detecting unit 5 (FIG. 2) are arranged in order from the upstream (right side) of the conveying belt 28, respectively. In the diagram, a point A denotes a transfer position, a point B indicates an exposing position. A distance that is equal to a circumferential distance on the photosensitive drum 14Y (FIG. 2) from the point A to the point B is shown by a point C on the conveying belt 28 (FIG. 2) (AB=AC).

Further, side elevational views of the recording media ((1) to (7)) before the printing which are moved on the conveying belt 28 are shown on the right side of the diagram and side elevational views of the recording media ((8) to (16)) after the fixing which are moved on the conveying belt 28 are shown on the left side of the diagram, respectively. Each of black bold lines written on the upper or lower surfaces of the recording media is an image showing the image portion fixed on the recording medium. In all of the diagrams, a value of each dimension is shown by the number of driving pulses which are supplied to the motor for rotating the belt driving roller to convey the medium by the distance corresponding to a value of each dimension. Explanation will be made hereinbelow on the assumption that the motor to rotate the belt driving roller is the motor A (FIG. 1).

It is assumed that the recording medium (1) denotes the non-printed recording medium of a medium length H1 and it is assumed that blank portions ΔL are formed from the front edge portion and the rear edge portion in the subscanning direction and an image of a length L0 in the subscanning direction is printed. If there is no medium contraction after the fixing, the blank portions ΔL are formed from the front edge portion and the rear edge portion in the subscanning direction and a black bold line ought to be formed in the length L0 in the subscanning direction as shown in the recording medium (8). However, the recording medium contracts to a medium length H2 due to the pressure of a high temperature which is applied by the fixing roller 30 and the fixing backup roller 31. When a contraction ratio at this time is assumed to be $\alpha$=H2/H1 here, the medium becomes short by H1(1−$\alpha$), the blank portion becomes a portion shown by $\alpha\Delta L$, and the image portion becomes a portion shown by $\alpha$L0 as shown in the recording medium (9).

A diagram showing the state where the recording medium is conveyed so as to print the same image again onto the opposite surface of the recording medium corresponds to the recording medium (2). Since $\Delta L>\alpha\Delta L$ as shown in the recording medium (2), the blank portion of the front edge portion of the first surface is smaller than the blank portion of the front edge portion of the opposite surface. The blank portion of the front edge portion of the opposite surface is the rear edge portion of the first surface (9) from the Note (1). The state where the opposite surface has been printed and fixed in this state is shown as a recording medium (10). The contraction by the fixing is ignored here. Therefore, on the opposite surface, since the blank portion of the front edge portion is ΔL and the image portion is held to be L0, the blank portion of the rear edge portion decreases remarkably as shown in the diagram. Thus, a difference between the image positions of the first surface and the opposite surface is largely conspicuous.

To eliminate such an inconvenience, in the embodiment, the write timing for the opposite surface is shifted by a predetermined amount as shown in the recording medium (3). It is now assumed that the write timing is made early by H1(1−$\alpha$)/2 (on the recording medium) as shown in the recording medium (3). That is, it is set to P1=P0−H1(1−$\alpha$)/2. P0 denotes a time (the number of driving pulses) which is required until the LED head 7Y (FIG. 1) starts the exposure after the medium supply detecting unit 4 was detected the front edge portion of the recording medium. The state where the opposite surface has been printed and fixed in this state is shown as a recording medium (11). As shown in the recording medium (11), when it is compared with the recording medium (10), the blank portion of the front edge portion of the print of the opposite surface is decreased by an amount of H1(1−$\alpha$)/2. This is equivalent to that the contraction H1(1−$\alpha$) due to the fixing has been center-distributed to the blank portion of the front edge portion and the blank portion of the rear edge portion of the print of the opposite surface by H1(1−$\alpha$)/2, respectively. Thus, the difference between the image positions of the first surface and the opposite surface is inconspicuous.

Processes in the case where the recording medium which is used for printing is longer than the medium length H1 designated by the upper apparatus 100 (FIG. 1) by Y will now be described. The recording medium (4) shows the non-printed recording medium of a medium length K1 (=H1+Y) and it is assumed that the blank portion ΔL is formed from the front edge portion in the subscanning direction and an image of the length L0 in the subscanning direction is printed. In this case, the blank portion from the rear edge portion becomes a portion of ΔL+Y. If there is no medium contraction after the fixing, the blank portion ΔL is formed in the front edge portion in the subscanning direction, the blank portion ΔL+Y is formed in the rear edge portion, and a black bold line ought to be formed in the length L0 in the subscanning direction as shown in the recording medium (12). However, the recording medium contracts to a medium length K2 due to the pressure of a high temperature which is applied by the fixing roller 30 and the fixing backup roller 31. When the contraction ratio is assumed to be $\alpha$=H2/H1 here (it is assumed that the same material as that of the recording medium (1) is used), the medium is shortened by K1(1−$\alpha$) as shown in the recording medium (13), the blank portion of the front edge portion becomes a portion shown by $\alpha\Delta L$, the blank portion of the rear edge portion becomes a portion shown by $\alpha(\Delta L+Y)$, and the image portion becomes a portion shown by $\alpha L0$.

A diagram showing the state where the recording medium is conveyed so as to print the same image again onto the opposite surface of the recording medium corresponds to the recording medium (5). Since $\Delta L<\alpha(\Delta L+Y)$ as shown in the recording medium (5), the blank portion of the front edge portion of the opposite surface is smaller than the blank portion of the front edge portion of the first surface. The blank portion of the front edge portion of the opposite surface is the rear edge portion of the first surface (9) from the Note (1). The state where the opposite surface has been printed and fixed in this state is shown as a recording medium (14). The contraction by the fixing is ignored here. Therefore, in the printing of the opposite surface, since the blank portion of the front edge portion is $\Delta L$ and the image portion is held to be L0, a difference between the image positions of the first surface and the opposite surface is largely conspicuous as shown in the diagram.

To eliminate such an inconvenience, in the embodiment, the write timing for the opposite surface is shifted by a predetermined amount as shown in the recording medium (6). It is now assumed that the write timing is made to be late by Y (on the recording medium) as shown in the recording medium (6). That is, it is set to P2=P0+Y. The state where the opposite surface has been printed and fixed in this state is shown as a recording medium (15). When the recording medium (15) is compared with the recording medium (14), the blank portion of the front edge portion of the print of the opposite surface is increased by an amount of Y. This is equivalent to that the error amount from the designated medium length H1 has been eliminated. However, the fluctuation amount due to the contraction is still included in it. Therefore, in a manner similar to the foregoing recording medium (3), by center-distributing $K1(1-\alpha)$, the blank portion of the front edge portion of the print of the opposite surface is decreased by $K1(1-\alpha)/2$ as shown in the recording medium (7). That is, it is set to $P3=P0+Y-K1(1-\alpha)/2$.

Thus, as shown in the recording medium (16), the contraction $K1(1-\alpha)$ due to the fixing of the first surface is center-distributed to the blank portion of the front edge portion of the opposite surface and the blank portion of the rear edge portion of the opposite surface by $K1(1-\alpha)/2$, respectively, and at the same time, the error amount from the designated medium length H1 has been eliminated. Consequently, the difference between the image positions of the first surface and the opposite surface is inconspicuous. The image forming apparatus of the embodiment operates as follows on the basis of the fundamental principle of the embodiment described above.

Returning to FIG. 2, the operation of the embodiment will now be described.

When the recording medium is supplied from the sheet cassette 21, conveyed by the conveying rollers 24 and 25, and reaches the medium supply detecting unit 4, the medium supply detecting unit 4 detects the recording medium and the control operation of the embodiment is started (turns it on). When the medium supply detecting unit 4 is turned on, the control unit 10 (FIG. 1) starts to count the number of driving pulses of the motor A (FIG. 1) (motor to rotate the belt driving roller 29). At the same time, when the medium supply detecting unit 4 detects the front edge of the medium on the basis of the control of the control unit 10 (FIG. 1), the write timing setting unit 2 (FIG. 1) sets the write timing so that the LED head 7Y starts the exposure after the number (P0) of driving pulses of the motor A (FIG. 1) was counted and the electrostatic latent image is formed on the photosensitive drum 14Y.

On the basis of the set write timing, the LED head 7Y starts the exposure after the driving pulses P0 and the electrostatic latent image is formed on the photosensitive drum 14Y. The toner image is formed on the photosensitive drum 14Y by the developing roller 16Y in accordance with the formed electrostatic latent image. At a point of time when the recording medium reaches between the photosensitive drum 14Y and the transfer roller 20Y, a voltage of about +2000V is applied to the transfer roller 20Y, the toner is attracted to the recording medium side, and the toner image is transferred onto the recording medium. Similarly, with respect to other colors, the exposure, development, and transfer are sequentially executed.

When the recording medium is conveyed and its rear edge portion passes through the medium supply detecting unit 4, the control unit 10 (FIG. 1) stops the counting operation of the number of driving pulses of the motor A (FIG. 1). The count value at this time is assumed to be H1. This H1 corresponds to the medium length of the recording medium in the non-printed state. The recording medium to which the toner image has been transferred is heated and pressurized, so that the toner image is fixed by the fixing device 40. After the fixing, when the front edge portion of the recording medium reaches the medium ejection detecting unit 5, the medium ejection detecting unit 5 starts the operation (turns it on) and the control unit 10 (FIG. 1) starts to count the number of driving pulses of the motor A (FIG. 1).

When the recording medium is conveyed and its rear edge portion passes through the medium ejection detecting unit 5, the control unit 10 (FIG. 1) stops the counting operation of the number of driving pulses of the motor A (FIG. 1). The count value at this time is assumed to be H2. This H2 corresponds to the medium length of the recording medium after the printing and fixing of the first surface.

At this time, the medium contraction amount calculating unit 1 (FIG. 1) obtains the medium contraction amount $H1-H2=H1(1-\alpha)$ on the basis of the control of the control unit 10 (FIG. 1). In this instance, $\alpha=H2/H1$.

In the case of the duplex printing mode, the separator 34 moves to the upper side in the diagram and guides the recording medium to the lower side in the diagram. The recording medium is guided to the lower side of the sheet cassette 21 in the diagram by the medium reversing rollers 35 and 36. After that, the reversing rollers 35 and 36 are reversely rotated and the recording medium is conveyed to the conveying rollers 24 and 25 and moved again along the same route as that mentioned above. At this time, the first surface and the opposite surface of the recording medium are turned over.

When the opposite surface is printed on the basis of the control of the control unit 10 (FIG. 1), the write timing setting unit 2 (FIG. 1) sets the number (P3) of driving pulses of the motor A (FIG. 1) until the LED heads 7 (Y, M, C, K) are exposed after the medium supply detecting unit 4 detected the front edge portion of the recording medium. As described in the fundamental principle of the embodiment 1, $P3=P0+Y-K1(1-\alpha)/2$. On the basis of this set value, the opposite surface is printed, the image is fixed, the resultant medium is ejected, and the operation is finished.

P0 denotes the number of driving pulses of the motor A (FIG. 1) until the LED heads 7 (Y, M, C, K) are exposed after the medium supply detecting unit 4 detected the front edge portion of the recording medium in the first printing. K1 denotes the medium length before printing of the recording medium which is actually used. $\alpha$(=H2/H1) denotes the medium contraction ratio due to the printing and fixing. Y denotes the error between the medium length of the recording medium which is actually used and the medium length H1 designated by the upper apparatus 100 (FIG. 1).

The contraction of the medium width will now be described. When the recording medium is conveyed, ordinarily, since the medium width is center-distributed on the conveying path, there is no need to correct the contraction of the medium width in particular. However, in the case where one end of the conveying path is used as a guide and the recording medium is come into contact with this guide and conveyed, or the like, it is also necessary to correct the contraction of the medium width. In this case, the main scanning direction writing position setting unit 3 (FIG. 1) makes the following correction on the basis of the control of the control unit 10 (FIG. 1).

Assuming that the medium width of the recording medium is set to Hw, the contraction amount of the medium width due to the printing and fixing of the first surface is equal to Hw(1−$\alpha$). In this instance, $\alpha$=H2/H1 in a manner similar to that mentioned above. Therefore, the main scanning direction writing position setting unit 3 (FIG. 1) corrects the writing position in the main scanning direction upon printing of the opposite surface by the value, Hw(1−$\alpha$)/2, obtained by center-distributing the contraction amount Hw(1−$\alpha$) of the medium width, so that the printing is executed.

As described above, according to the embodiment, since the image forming apparatus has the medium contraction amount calculating unit and the write timing setting unit and the contraction amount due to the printing of the first surface is center-distributed on the image of the opposite surface, particularly, an effect that in the case where the same image is printed onto the both surfaces or onto the same surface, the positional change of the same image can be made inconspicuous is obtained.

Although the embodiment has been described above only with respect to the case of printing the image onto the both surfaces of the recording medium, the invention is not limited only to such an example but can be also applied to the case where the same image is printed onto the same surface. However, in this case, since there is no need to reverse the recording medium, it is unnecessary to correct the error between the medium length K1 of the recording medium which is actually used and the medium length H1 designated by the upper apparatus 100 (FIG. 1). The correction amount is equal to P1=P0−K1(1−$\alpha$)/2.

Further, although the embodiment has been described above only with respect to the case where the medium contraction amount calculating unit 1, the write timing setting unit 2, and the main scan writing position setting unit 3 are constructed by the control means of the CPU (central processing unit) which controls the whole image forming apparatus, the invention is not limited only to such an example. That is, all or a part of the medium contraction amount calculating unit 1, the write timing setting unit 2, and the main scan writing position setting unit 3 can be constructed by dedicated electronic circuits, respectively.

Embodiment 2

Figure 4:
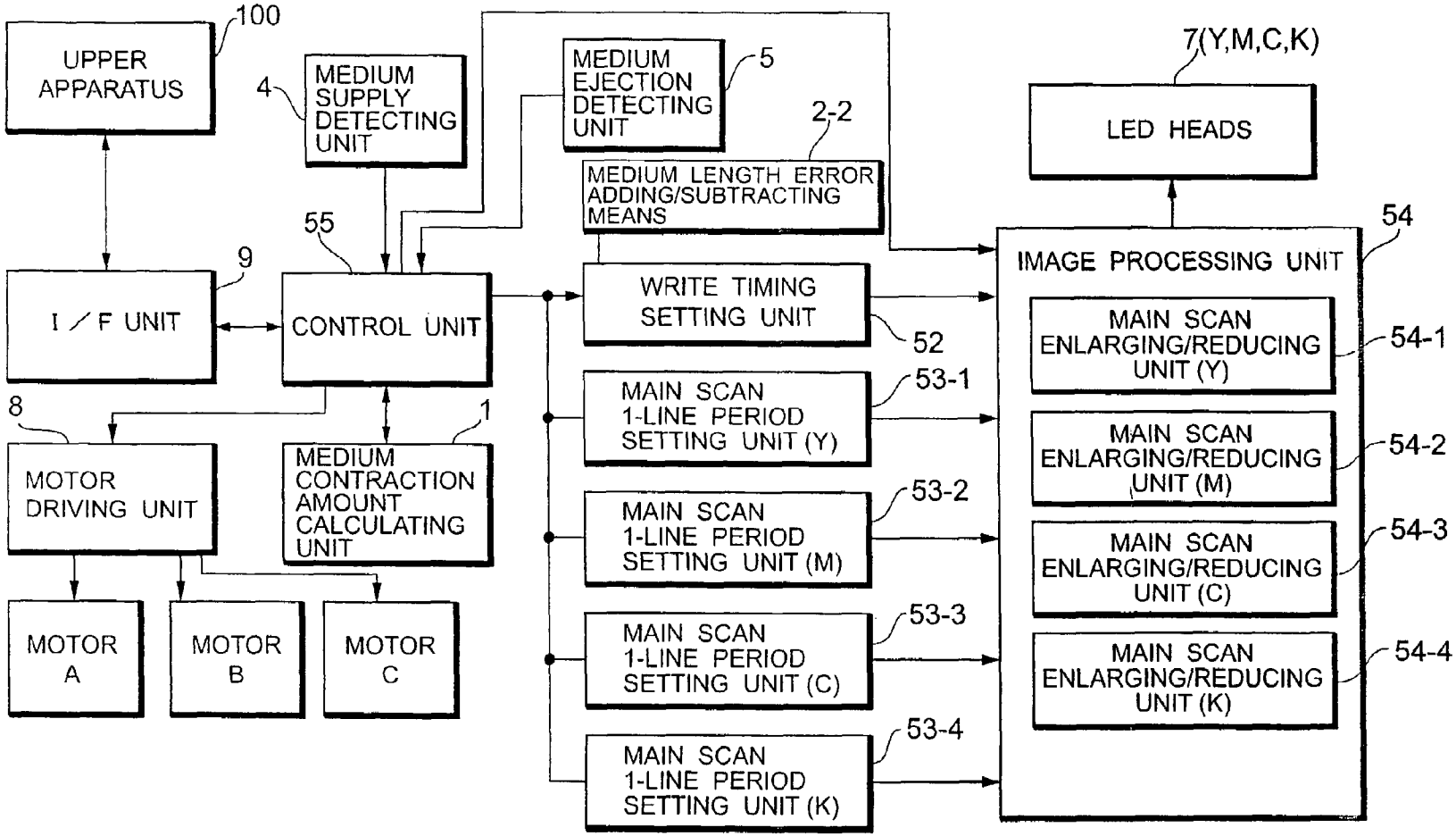
FIG. 4 is a block diagram of a construction of the embodiment 2.

FIG. 4 is a block diagram of a construction of the embodiment 2.

As shown in the diagram, an image forming apparatus of the embodiment 2 comprises: the medium supply detecting unit 4; the medium ejection detecting unit 5; the LED heads 7; the motor driving unit 8; the I/F unit 9; a write timing setting unit 52; a main scan 1-line period setting unit (Y) 53-1; a main scan 1-line period setting unit (M) 53-2; a main scan 1-line period setting unit (C) 53-3; a main scan 1-line period setting unit (K) 53-4; an image processing unit 54; and a control unit 55. Only points different from those in the embodiment 1 will be described with respect to the component portions. Component elements similar to those in the embodiment 1 are designated by the same reference numerals as those in the embodiment 1.

The write timing setting unit 52 is a portion for setting the timing when the LED heads 7 (Y, M, C, K) expose the images corresponding to the image data onto the photosensitive drums 14 (Y, M, C, K) on the basis of the time when the front edge portion of the recording medium is detected by the medium supply detecting unit 4. The write timing setting unit 52 has therein only the medium length error adding/subtracting means 2-2 and is also a portion for setting the image write timing in the printing of the opposite surface of the recording medium. However, unlike the embodiment 1, the write timing setting unit 52 does not have the medium contraction amount distributing means 2-1.

The main scan 1-line period setting units (Y, M, C, K) 53-1 to 53-4 are portions for setting light emitting periods of the LED heads 7 (Y, M, C, K) of the four colors on the basis of the control of the control unit 55.

The image processing unit 54 is a portion for forming the image data on the basis of the image information received from the upper apparatus 100 and sending it to the LED heads 7 (Y, M, C, K). Further, the image processing unit 54 has therein a main scan enlarging/reducing unit (Y) 54-1, a main scan enlarging/reducing unit (M) 54-2, a main scan enlarging/reducing unit (C) 54-3, and a main scan enlarging/reducing unit (K) 54-4 and is a portion for enlarging or reducing the image in the main scanning direction every color on the basis of the control of the control unit 55.

The control unit 55 is a CPU (central processing unit) which controls the whole image forming apparatus.

Since a mechanism portion of the image forming apparatus to which the embodiment 2 is applied is substantially similar to that of the embodiment 1, its description is omitted and a fundamental principle of the embodiment 2 will now be described.

Figure 5:
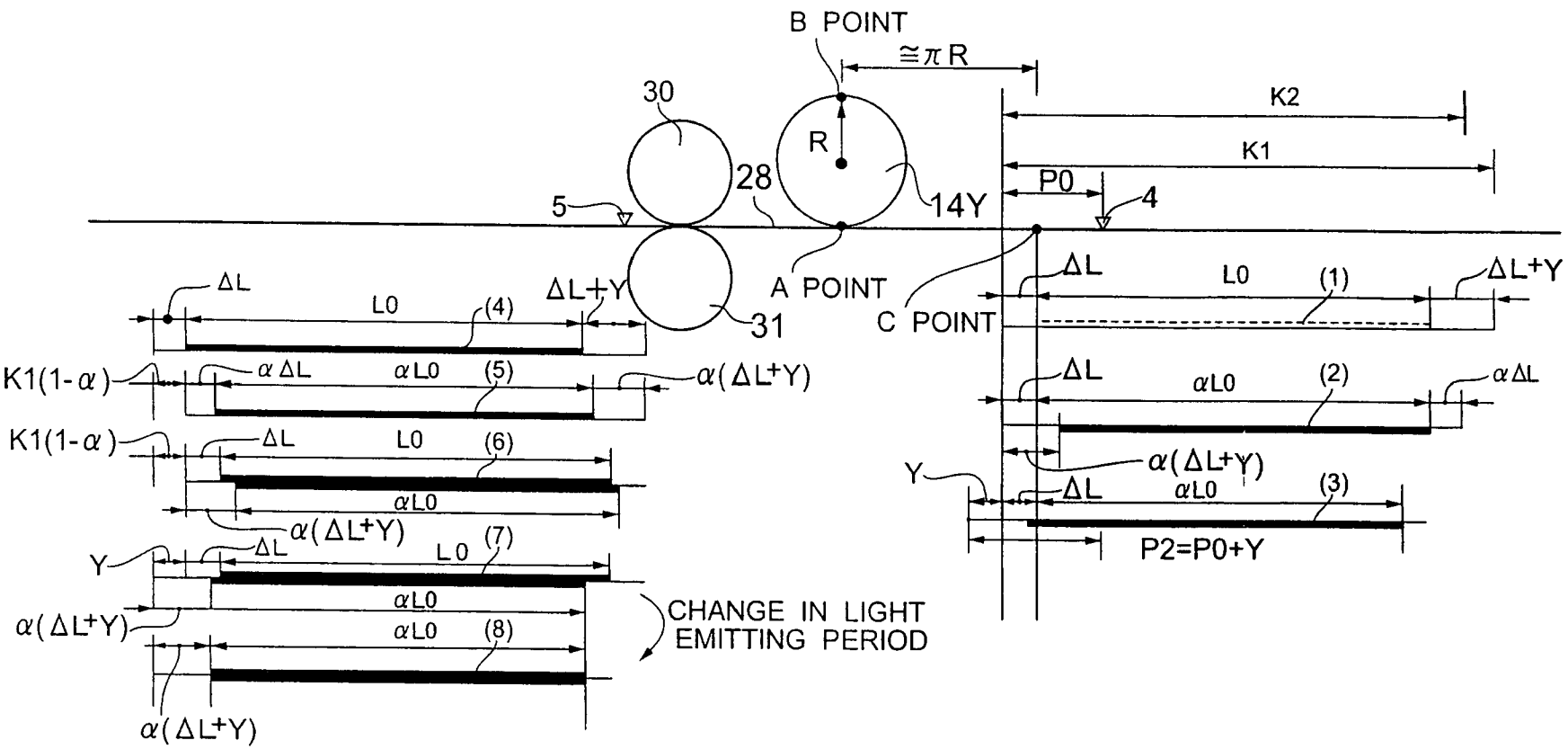
FIG. 5 is an explanatory diagram of a fundamental principle of the embodiment 2.

FIG. 5 is an explanatory diagram of the fundamental principle of the embodiment 2.

An image of a conveying path of the image forming apparatus according to the invention is illustrated at the top stage of the diagram. A black line drawn from the right end to the left end in the diagram is an image of the conveying belt 28 (FIG. 2) and it is assumed that the medium supply detecting unit 4 (FIG. 2), the photosensitive drum 14Y (FIG. 2), the fixing roller 30 (FIG. 2), the fixing backup roller 31 (FIG. 2), and the medium ejection detecting unit 5 (FIG. 2) are arranged in order from the upstream (right side) of the conveying belt 28, respectively. In the diagram, the point A denotes the transfer position, the point B indicates the exposing position. The distance that is equal to the circumferential distance on the photosensitive drum 14Y (FIG. 2) from the point A to the point B is shown by the point C on the conveying belt 28 (FIG. 2).

Further, side elevational views of the recording media ((1) to (3)) before the printing which are moved on the conveying belt 28 are shown on the right side of the diagram and side elevational views of the recording media ((4) to (8)) after the fixing which are moved on the conveying belt 28 are shown on the left side of the diagram, respectively. Each of black bold lines written on the upper or lower surfaces of the recording media is an image showing the image portion fixed on the recording medium. In all of the diagrams, the value of each dimension is shown by the number of driving pulses which are supplied to the motor for rotating the belt driving roller to convey the medium by the distance corresponding to the value of each dimension. Explanation will be made hereinbelow on the assumption that the motor to rotate the belt driving roller is the motor A (FIG. 1).

Only the processes in the case where the recording medium which is used for printing is longer than the medium length H1 designated by the upper apparatus 100 (FIG. 1) by Y will now be described. The recording medium (1) shows the non-printed recording medium of the medium length K1 (=H1+Y) and it is assumed that the blank portion ΔL is formed from the front edge portion in the subscanning direction and the image of the length L0 in the subscanning direction is printed. In this case, the blank portion from the rear edge portion becomes the portion of ΔL+Y. (Since the image is printed to the center of the recording medium in the embodiment,) if there is no medium contraction after the fixing, the blank portion ΔL is formed in the front edge portion in the subscanning direction, the blank portion ΔL+Y is formed in the rear edge portion, and the black bold line ought to be formed in the length L0 in the subscanning direction as shown in the recording medium (4). However, the recording medium contracts to the medium length K2 due to the pressure at the high temperature which is applied by the fixing roller 30 and the fixing backup roller 31. When the contraction ratio at this time is assumed to be α=K2/K1=H2/H1 here (it is assumed that the same material as that in the embodiment 1 is used), the medium is shortened by K1(1−α) as shown in the recording medium (5), the blank portion of the front edge portion becomes the portion shown by αΔL, the blank portion of the rear edge portion becomes the portion shown by α(ΔL+Y), and the image portion becomes the portion shown by αL0.

A diagram showing the state where the recording medium is conveyed so as to print the same image again onto the opposite surface of the recording medium corresponds to the recording medium (2). Since ΔL<α(ΔL+Y) as shown in the recording medium (2), the blank portion of the front edge portion of the print of the opposite surface is smaller than the blank portion of the front edge portion of the print of the first surface. The blank portion of the front edge portion of the print of the opposite surface is the rear edge portion of the print of the first surface (6) from the Note (1). The state where the opposite surface has been printed and fixed in this state is shown as a recording medium (6). The contraction due to the fixing is ignored here. Therefore, in the opposite surface printing, the blank portion of the front edge portion is ΔL and the image portion is held to be L0. Thus, a difference between the image positions of the first surface and the opposite surface is largely conspicuous as shown in the diagram.

To eliminate such an inconvenience, in the embodiment, the write timing for the opposite surface is shifted by a predetermined amount as shown in the recording medium (3). It is now assumed that the write timing is made to be late by Y as shown in the recording medium (3). That is, it is set to P2=P0+Y. The state where the opposite surface has been printed and fixed in this state is shown as a recording medium (7). When the recording medium (7) is compared with the recording medium (6), the blank portion of the front edge portion of the print of the opposite surface is increased by an amount of Y. This is equivalent to that the error amount from the designated medium length H1 has been eliminated. However, the fluctuation amount due to the contraction is not eliminated according to such a method.

Therefore, in the embodiment, the main scan 1-line period setting unit (Y) 53-1 changes a period T of the light emission of one line which is executed by the LED head 7Y. That is, if the light emitting period T is shortened, the blank portion and the image portion on the recording medium are shortened in proportion thereto.

In the embodiment, assuming that a light emitting period of one line in the first surface printing is set to T0, if the 1-line light emitting period upon printing of the opposite surface is equal to T1, it is set to T1=T0*K2/K1 (=H2/H1). Since K2/K1 (=H2/H1) is the contraction ratio due to the printing and fixing of the first surface, by changing the 1-line light emitting period of the opposite surface to T1, the contraction amount of the medium due to the printing and fixing of the first surface is cancelled.

Thus, if the recording medium (3) is printed at the 1-line light emitting period T1, it becomes the recording medium (8). In this instance, the contraction amount of the medium is cancelled and the position of the image on the first surface and that on the opposite surface coincide. In this case, by reducing the image in the main scanning direction at the contraction ratio due to the printing and fixing of the first surface, the positional deviation between the position of the image on the first surface and that on the opposite surface can be corrected not only in the subscanning direction but also in the main scanning direction. In this case, however, if the image is simply reduced, since the number of pixels is insufficient, it is necessary to add the pixels corresponding to the half of the number of pixels which were decreased due to the size reduction of the image to both sides of the image. The image forming apparatus of the embodiment operates as follows on the basis of the fundamental principle of the embodiment as described above.

The operation in the embodiment will now be described with reference to FIG. 2 again.

When the recording medium is supplied from the sheet cassette 21, conveyed by the conveying rollers 24 and 25, and reaches the medium supply detecting unit 4, the medium supply detecting unit 4 detects the recording medium and the control operation of the embodiment is started (turns it on). When the medium supply detecting unit 4 is turned on, the control unit 55 (FIG. 4) starts to count the number of driving pulses of the motor A (FIG. 4) (motor to rotate the belt driving roller 29). At the same time, when the medium supply detecting unit 4 detects the front edge of the medium on the basis of the control of the control unit 55 (FIG. 4), the write timing setting unit 52 (FIG. 4) sets the write timing so that the LED head 7Y starts the exposure after the number (P0) of driving pulses of the motor A (FIG. 4) was counted and the electrostatic latent image is formed on the photosensitive drum 14Y.

On the basis of the set write timing, the LED head 7Y starts the exposure after the driving pulses P0 and the electrostatic latent image is formed on the photosensitive drum 14Y. The toner image is formed on the photosensitive drum 14Y by the developing roller 16Y in accordance with the formed electrostatic latent image. At the point of time when the recording medium reaches between the photosensitive drum 14Y and the transfer roller 20Y, the voltage of about +2000V is applied to the transfer roller 20Y, the toner is attracted to the recording medium side, and the toner image is transferred onto the recording medium. Also with respect to other colors, the exposure, development, and transfer are similarly sequentially executed.

When the recording medium is conveyed and its rear edge portion passes through the medium supply detecting unit 4, the control unit 55 (FIG. 4) stops the counting operation of the number of driving pulses of the motor A (FIG. 4). The count value at this time is assumed to be H1. The recording medium to which the toner image has been transferred is heated and pressurized, so that the toner image is fixed by the fixing device 40. After the fixing, when the front edge portion of the recording medium reaches the medium ejection detecting unit 5, the medium ejection detecting unit 5 starts the operation (turns it on) and the control unit 55 (FIG. 4) starts to count the number of driving pulses of the motor A (FIG. 4).

When the recording medium is conveyed and its rear edge portion passes through the medium ejection detecting unit 5, the control unit 55 (FIG. 4) stops the counting operation of the number of driving pulses of the motor A (FIG. 4). The count value at this time is assumed to be H2. At this time, the medium contraction amount calculating unit 1 (FIG. 4) obtains the medium contraction amount $H1-H2=H1(1-\alpha)$ on the basis of the control of the control unit 55 (FIG. 4). In this instance, $\alpha=H2/H1$.

In the case of the duplex printing mode, the separator 34 moves to the upper side in the diagram and guides the recording medium to the lower side in the diagram. The recording medium is guided to the lower side of the sheet cassette 21 in the diagram by the medium reversing rollers 35 and 36. After that, the reversing rollers 35 and 36 are reversely rotated and the recording medium is conveyed to the conveying rollers 24 and 25 and moved again along the same route as that mentioned above. At this time, the first surface and the opposite surface of the recording medium are turned over.

When the opposite surface is printed on the basis of the control of the control unit 55 (FIG. 4), the write timing setting unit 52 (FIG. 4) sets the number (P2) of driving pulses of the motor A (FIG. 4) until the LED heads 7 (Y, M, C, K) are exposed after the medium supply detecting unit 4 detected the front edge portion of the recording medium. As described in the fundamental principle of the embodiment 2, $P2=P0+Y$. The main scan 1-line period setting units (Y, M, C, K) 53-1 to 53-4 set the 1-line light emitting period on the opposite surface to $T1=T0*K2/K1$ $(=H2/H1)=T0*\alpha$. Further, the main scan enlarging/reducing units (Y, M, C, K) 54-1 to 54-4 reduce the image in the main scanning direction at the contraction ratio $\alpha=K2/K1$ $(=H2/H1)$ due to the printing and fixing of the first surface. On the basis of those set values, the opposite surface is printed, the image is fixed, the resultant medium is ejected, and the operation is finished.

P0 denotes the number of driving pulses of the motor A (FIG. 4) until the LED heads 7 (Y, M, C, K) are exposed after the medium supply detecting unit 4 detected the front edge portion of the recording medium in the printing of the first surface. K1 denotes the medium length before printing of the recording medium which is actually used. $\alpha(=H2/H1)$ denotes the medium contraction ratio due to the printing and fixing. Y denotes the error between the medium length of the recording medium which is actually used and the medium length H1 designated by the upper apparatus 100 (FIG. 4). T0 denotes a period of one main scanning line in the first printing.

In the above description, although the image reduction upon printing of the opposite surface in the subscanning direction has been executed in an analogwise manner by changing the light emitting periods of the LED heads 7 (Y, M, C, K), the image can be also reduced by using an image processing technique such as a process for decimating the image or the like.

Although the embodiments have been described above with respect to the case where the medium contraction amount calculating unit 1, the write timing setting unit 52, the main scan 1-line period setting units (Y, M, C, K) 53-1 to 53-4, and the main scan enlarging/reducing units (Y, M, C, K) 54-1 to 54-4 are constructed by the control means of the CPU (central processing unit) which controls the whole image forming apparatus, the invention is not limited only to such an example. That is, all or a part of the above-mentioned units can be constructed by dedicated electronic circuits, respectively.

As described above, since the image forming apparatus of the embodiment has the main scan 1-line period setting units (Y, M, C, K) 53-1 to 53-4 and the main scan enlarging/reducing units (Y, M, C, K) 54-1 to 54-4, by correcting the contraction amount due to the printing of the first surface on the image of the opposite surface, particularly, in the case where the same image is printed onto the both surfaces or onto the same surface, an effect that the positional change of the same image can be eliminated is obtained.

Although the embodiments have been described above with respect only to the case of printing onto the both surfaces of the recording medium, the invention is not limited only to such an example but can be also applied to the case where the same image is printed onto the same surface. In this case, however, since there is no need to reverse the recording medium, naturally, it is unnecessary to correct the error between the medium length K1 of the recording medium which is actually used and the medium length H1 designated by the upper apparatus 100 (FIG. 1).

Further, although the expression "first surface" and "opposite surface" has been used with respect to the print surface of the recording medium in the foregoing embodiments 1 and 2, the reasons why they are used are that in the ordinary duplex (two-sided) printer, after the obverse surface (the surface whose page number is small) of the recording medium was printed, the reverse surface (the surface whose page number is large) is not always printed. In other words, in the above description, the surface which was first printed is expressed as a first surface and the surface which was printed next is expressed as an opposite surface irrespective of the page numbers, respectively.

Although the embodiments have been described above on the assumption that the application example of the invention is limited only to the printer, the invention is not limited only to such an example. That is, the invention can be applied to any apparatus (for example, copying apparatus) so long as it has the function of printing an image onto both surfaces of a recording medium or the function of printing an image onto the same surface a plurality of number of times and uses the thermal fixing system.

The present invention is not limited to the foregoing embodiments but many modifications and variations are possible within the spirit and scope of the appended claims of the invention.

What is claimed is:

1. An image forming apparatus that performs image formation at least twice on one recording medium comprising:

a write timing setting unit for setting a predetermined writing timing to start the image formation a first time on the recording medium; and an image formation timing setting unit for shifting the writing timing to start the image formation on the recording medium after the first time with respect to the predetermined writing timing that was used the first time, on the basis of a medium length contraction amount.

2. An image forming apparatus comprising:

a medium contraction amount calculating unit which calculates a medium length contraction amount on the basis of a medium length of a recording medium before a fixing process for fixing an image formed on said recording medium, and on the basis of a medium length of said recording medium after said fixing process;

an image formation timing setting unit for setting a timing to form an image on a subsequent recording medium which will be subsequently printed, on the basis of said medium length contraction amount calculated by said medium contraction amount calculating unit; and a medium conveyance amount calculating unit which calculates a medium conveyance amount which corresponds to said medium length contraction amount calculated by said medium contraction amount calculating unit, wherein said image formation timing setting unit, in order to set the timing to form an image on the subsequent recording medium which will be subsequently printed, uses said medium conveyance amount corresponding to said medium length contraction amount.

3. The image forming apparatus according to claim 2, further comprising:

a conveyance amount dividing unit for apportioning said medium conveyance amount calculated by said medium conveyance amount calculating unit to said subsequent recording medium which will be subsequently printed, between a printing start and a printing end.

4. The image forming apparatus according to claim 2, wherein said image formation timing setting unit has a timing adding/subtracting portion that adds/subtracts said medium conveyance amount to/from a printing start time.

5. The image forming apparatus according to claim 4, wherein said timing adding/subtracting portion detects an error amount between the medium length before said fixing process and a length that is stored in correspondence to said recording medium, and adds/subtracts a medium conveying amount corresponding to said error amount to/from a printing start timing of said subsequent recording medium.

6. The image forming apparatus according to claim 2, further comprising a main scan enlarging/reducing unit which enlarges or reduces an image in the next and subsequent printing in a main scanning direction on the basis of said medium length contraction amount.

7. The image forming apparatus, according to claim 1, further comprising:

a medium contraction amount calculating unit which calculates the medium length contraction amount on the basis of a medium length of the recording medium before a fixing process for fixing the image formed on said recording medium the first time, and on the basis of a medium length of said recording medium after said fixing process.

8. An image forming apparatus comprising:

a medium contraction amount calculating unit which calculates a medium length contraction amount on the basis of a medium length of a recording medium before a fixing process for fixing an image formed on said recording medium, and on the basis of a medium length of said recording medium after said fixing process;

an image formation timing setting unit for setting a timing to form an image on a subsequent recording medium which will be subsequently printed, on the basis of said medium length contraction amount calculated by said medium contraction amount calculating unit; and a medium conveyance time calculating unit which calculates a medium conveyance time which corresponds to said medium length contraction amount calculated by said medium contraction amount calculating unit, wherein said image formation timing setting unit, in order to set the timing to form an image on the subsequent recording medium which will be subsequently printed, uses said medium conveyance time corresponding to said medium length contraction amount.

9. The image forming apparatus according to claim 8, wherein said image formation timing setting unit has a timing adding/subtracting portion that adds/subtracts said medium conveyance time to/from the printing start time.

10. The image forming apparatus according to claim 9, wherein said timing adding/subtracting portion detects an error amount between the medium length before said fixing process and a length that is stored in correspondence to said recording medium, and adds/subtracts a medium conveying time corresponding to said error amount to/from a printing start timing of said subsequent recording medium.

11. An image forming apparatus comprising:

a medium contraction amount calculating unit which calculates a medium length contraction amount on the basis of a medium length of a recording medium before a fixing process for fixing an image formed on said recording medium, and on the basis of a medium length of said recording medium after said fixing process;

an image formation timing setting unit for setting a timing to form an image on a subsequent recording medium which will be subsequently printed, on the basis of said medium length contraction amount calculated by said medium contraction amount calculating unit; and a main scan writing position changing unit which converts said medium length contraction amount into a medium width contraction amount in a main scanning direction, and on the basis of said medium width contraction amount, changes a main scan writing position in the next and subsequent printing.

12. An image forming apparatus that performs image formation at least twice on one recording medium, comprising:

an exposing device period setting unit for shifting a predetermined exposing timing used during image formation on the recording medium a first time to provide a shifted exposure timing for use during image formation on the recording medium after the first time device in the next and subsequent printing on the basis of a medium length contraction amount.

13. The image forming apparatus according to claim 12, further comprising a main scan writing position changing unit which converts said medium length contraction amount into a medium width contraction amount in a main scanning direction, and on the basis of said medium width contraction amount, changes a main scan writing position in the next and subsequent printing.

14. The image forming apparatus, according to claim 12, further comprising:

a medium contraction amount calculating unit which calculates the medium length contraction amount on the basis of the length of the recording medium before a fixing process for fixing the image formed on the recording medium the first time, and on the basis of the length of the recording medium after said fixing process.

15. The image forming apparatus according to claim 13, further comprising a main scan enlarging/reducing unit which enlarges or reduces an image in the next and subsequent printing in a main scanning direction on the basis of said medium length contraction amount.

16. An image forming apparatus comprising:

a medium contraction amount calculating unit which calculates a medium length contraction amount on the basis of a medium length of a recording medium before a fixing process for fixing an image formed on said recording medium, and on the basis of a medium length of said recording medium after said fixing process;

an exposing device period setting unit which sets an operating period of an exposing device in the next and subsequent printing on the basis of said medium length contraction amount.

a medium conveyance time calculating unit which calculates a medium conveyance time which corresponds to said medium length contraction amount calculated by said medium contraction amount calculating unit, wherein said exposing device period setting unit, in order to set said operating period of an exposing device in the next and subsequent printing, uses said medium conveyance time corresponding to said medium length contraction amount.

17. The image forming apparatus according to claim 16, wherein said exposing device period setting unit has a timing adding/subtracting portion that adds/subtracts said medium conveyance time to/from an exposing start time in the next and subsequent printing.

18. The image forming apparatus according to claim 17, wherein said timing adding/subtracting portion detects an error amount between the medium length before said fixing process and a length that is stored in correspondence to said recording medium, and adds/subtracts said medium conveying time corresponding to said error amount to/from said exposing start timing in the next and subsequent printing.

* * * * *